US009613484B2

(12) United States Patent
Hancock et al.

(10) Patent No.: US 9,613,484 B2
(45) Date of Patent: Apr. 4, 2017

(54) SHELVING AND KIOSK SYSTEM

(75) Inventors: Stephen H. Hancock, Wake Forest, NC (US); Norman B. Desrosiers, Oxford, NC (US); Eric Fiest, Raleigh, NC (US); John Rupert, Raleigh, NC (US)

(73) Assignee: Flextronics AP, LLC, San Jose, CA (US)

( * ) Notice: Subject to any disclaimer, the term of this patent is extended or adjusted under 35 U.S.C. 154(b) by 877 days.

(21) Appl. No.: 13/563,255

(22) Filed: Jul. 31, 2012

(65) Prior Publication Data

US 2014/0034589 A1 Feb. 6, 2014

(51) Int. Cl.

| | |
|---|---|
| ***G07F 11/42*** | (2006.01) |
| ***A47F 1/04*** | (2006.01) |
| ***G07F 17/12*** | (2006.01) |
| ***G07F 11/16*** | (2006.01) |

(52) U.S. Cl.

CPC ..... *G07F 17/12* (2013.01); *A47F 1/04* (2013.01); *G07F 11/165* (2013.01); *G07F 11/42* (2013.01)

(58) Field of Classification Search

CPC ..... A47F 1/04; G07F 17/12; G07F 11/165; G07F 11/42

See application file for complete search history.

(56) References Cited

U.S. PATENT DOCUMENTS 5,255,802 A * 10/1993 Krinke ..... A47F 5/005 211/184
5,593,048 A * 1/1997 Johnson ..... A47F 1/04 211/184
6,168,032 B1 1/2001 Merl
6,705,477 B1 3/2004 Narkis et al.
7,028,852 B2 * 4/2006 Johnson et al. ..... 211/59.3
7,182,209 B2 * 2/2007 Squitieri ..... A47F 5/005 211/184

(Continued)

FOREIGN PATENT DOCUMENTS

DE 19939211 A1 3/2001
FR 2735669 A1 12/1996

OTHER PUBLICATIONS

International Search Report and Written Opinion for PCT/US2013/052903, dated Oct. 1, 2013, 11 pp.

*Primary Examiner* — Michael McCullough
*Assistant Examiner* — Ashley Romano
(74) *Attorney, Agent, or Firm* — Volpe and Koenig, P.C.

(57) ABSTRACT

Described herein are a robotic distribution apparatus, system and method. The robotic distribution system may include a Package Delivery Kiosk (PDK), associated front end and back end package delivery management systems, portals for the consumer and the retailer, portals for the common carrier, sender, and recipient, a package inventory management system, integrated retailer access, a real and automated retailer bidding system and a kiosk for distribution. The PDK includes a distribution kiosk and shelving system. The kiosk and shelving system includes configurable shelves and dividers to enable access to the packages. The shelving system handles packages from a robotic placement mechanism and includes shelves that have receiving apertures. The shelving system further includes dividers that fit into the receiving apertures. Each of the dividers has a receiving slot that allows a robotic gripper arm to grab or handle a package with respect to a slot between a pair of dividers.

20 Claims, 16 Drawing Sheets

(56) References Cited

U.S. PATENT DOCUMENTS

| | | | | |
|---|---|---|---|---|
| 7,784,413 | B2 * | 8/2010 | Gabriel | A01K 1/031 108/60 |
| 7,837,059 | B2 * | 11/2010 | Hieb | G07F 11/10 221/122 |
| 8,739,958 | B2 * | 6/2014 | Freudelsperger | 198/347.1 |
| 8,925,744 | B1 * | 1/2015 | Jang | A47F 1/12 211/126.12 |
| 2007/0075028 | A1 | 4/2007 | Nagel et al. | |

* cited by examiner

SHELVING AND KIOSK SYSTEM

CROSS REFERENCE TO RELATED APPLICATIONS

This application is related to co-pending application entitled "ROBOTIC PACKAGE LIFTING ASSEMBLY AND METHOD" Ser. No. 13/563,158, filed concurrently herewith; co-pending application entitled "AUTOMATIC PACKAGE DELIVERY AND RETRIEVAL SYSTEM" Ser. No. 13/563,317, filed concurrently herewith; co-pending application entitled "ON DEMAND KIOSK COMMERCE SYSTEM AND METHOD" Ser. No. 13,563,361, filed concurrently herewith; and co-pending application entitled "PACKAGE DELIVERY KIOSK INCLUDING INTEGRATED ROBOTIC PACKAGE LIFTING ASSEMBLY WITH SHELVING SYSTEM" Ser. No. 13/563,410, filed concurrently herewith; the contents of which are hereby incorporated by reference herein.

BACKGROUND

The cost associated with operating a physical store front or delivering packages via mail or other package delivery common carriers is a significant expense of doing business. The last mile of delivery of packages is many times a large percentage of the expense of delivery, especially as compared to the total distance a package travels. In some cases, individuals living in apartment type dwellings can only receive packages if they are there to physically sign for them. Considering the hours of delivery and the hours most people work, home delivery is therefore impossible. In this case the resident must go to a post office or other depot during business hours. This provides for similar difficulty.

Increasingly consumers desire immediate satisfaction of orders and purchases. In order to do so they request express shipping, (at some cost), or go to a physical store front. When going to a physical store front, the consumer may not feel as though they are getting the best prices so they may be reluctant to purchase. Consumers may return home and search on Internet shopping sites in order to obtain the best price. Also, the store may not be open or may be far away. In such case they delay acquisition of the item of interest.

Therefore the ability to store packages in a protected kiosk from which they may be retrieved using a robotic apparatus is needed.

BRIEF SUMMARY

Described herein are a robotic distribution apparatus, system and method. The robotic distribution system may include a Package Delivery Kiosk (PDK), associated front end and back end package delivery management systems, portals for the consumer and the retailer, portals for the common carrier, sender, and recipient, a package inventory management system, integrated retailer access, a real and automated retailer bidding system and a kiosk for distribution. The PDK includes a distribution kiosk and shelving system. The kiosk and shelving system includes configurable shelves and dividers to enable access to the packages. The shelving system handles packages from a robotic placement mechanism and includes shelves that have receiving apertures. The shelving system further includes dividers that fit into the receiving apertures. Each of the dividers has a receiving slot that allows a robotic gripper arm to grab or handle a package with respect to a slot between a pair of dividers.

BRIEF DESCRIPTION OF THE FIGURES

A more detailed understanding may be had from the following description, given by way of example in conjunction with the accompanying drawings wherein.

DETAILED DESCRIPTION

Figure 1:
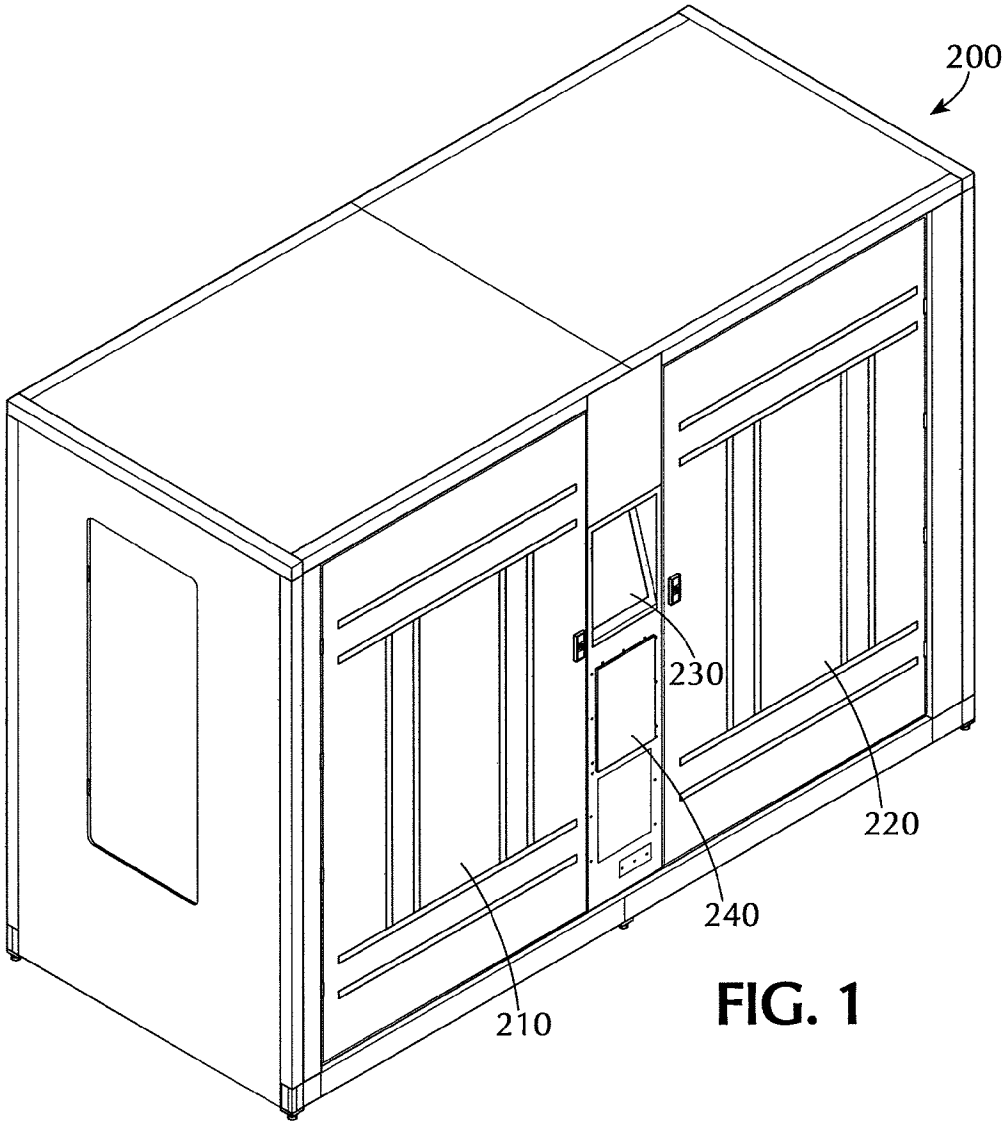
FIG. 1 shows a perspective view of one embodiment of a kiosk for remotely distributing packages.

Certain terminology is used herein for convenience only and is not to be taken as a limitation on the embodiments of a Robotic Package Lifting Assembly. In the drawings, the same reference letters are employed for designating the same elements throughout the several figures.

The words "right", "left", "front", and "back" designate directions in the drawings to which reference is made. The words "inwardly" and "outwardly" refer to directions toward and away from, respectively, the geometric center of the case with flexible body portion and designated parts thereof. The terminology includes the words above specifically mentioned, derivatives thereof, and words of similar import. The drawings are proportional.

Like reference numerals designate like or corresponding parts throughout the various views and with particular reference to each of the figures as delineated below.

FIG. 1 shows a perspective view of one embodiment of a kiosk 200 for distributing packages. Kiosk 200 is secure and surrounded by a number of panels. The kiosk 200 may be secured internally using a locking system controlled by a code accessible security system, may be secured using an external lock, or any number of security means. The kiosk 200 may have, for example, two panels 210 and 220. However, the kiosk 200 may include any number of panels. A package distribution slot 240 in kiosk 200 provides for distribution of packages. An interface 230 may be a touch screen interface or may include a separate interface such as a keyboard or mouse. These kiosks are built to be secure by providing limited access to the kiosk through the usage of secured cabinet doors. These kiosks may be provided in a variety of locations including, stores, malls, post offices, apartment buildings, and any other areas that provide for significant public access.

Figure 2:
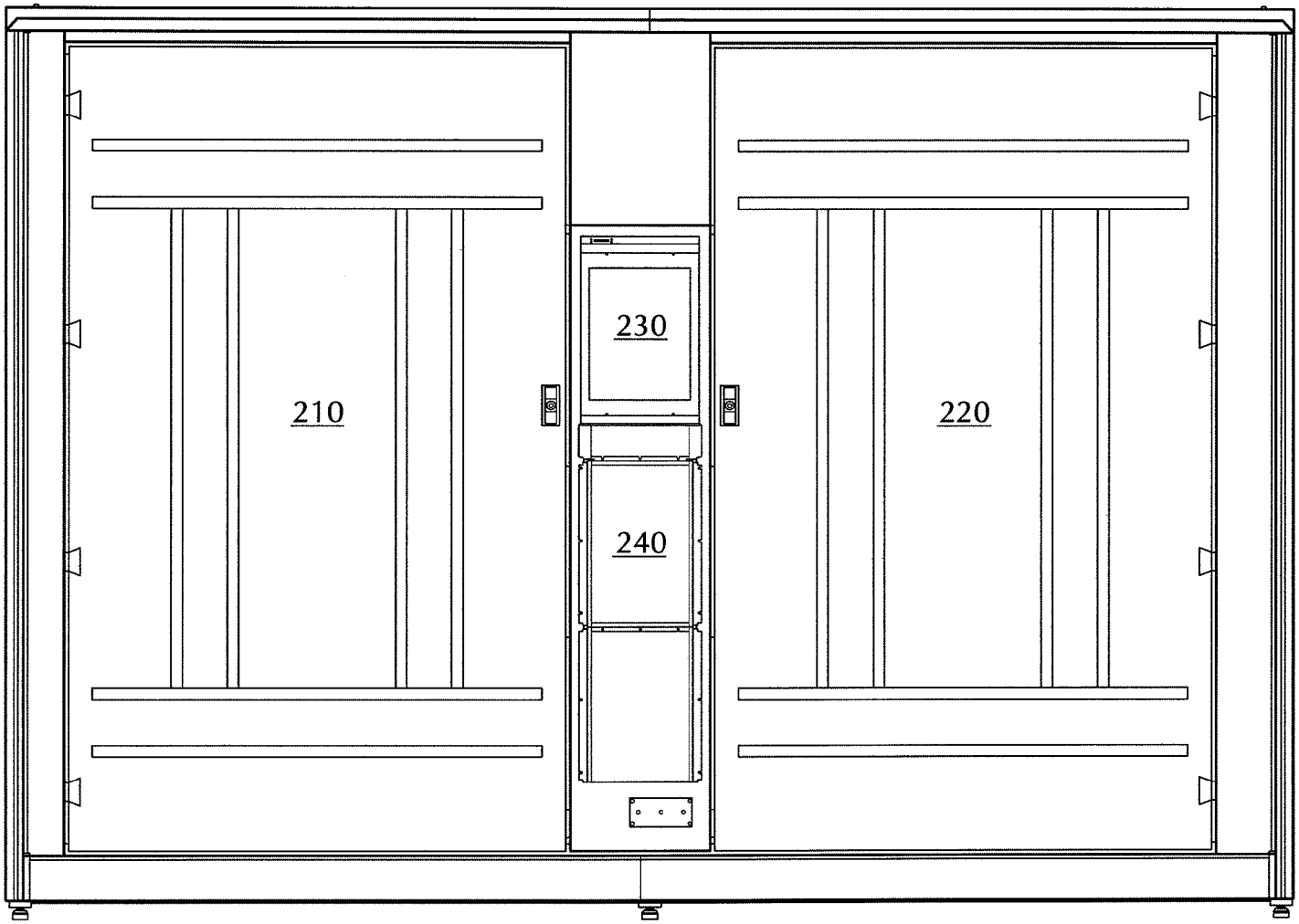
FIG. 2 shows a front view of the kiosk of FIG. 1.

FIG. 2 shows a landscape view of the kiosk 200. In the embodiment shown, a locking mechanism is shown in each panel 210 and 220. In alternative embodiments, one panel may have an externally accessible locking mechanism. The other panels may be releasable only via an external latch.

Figure 3:
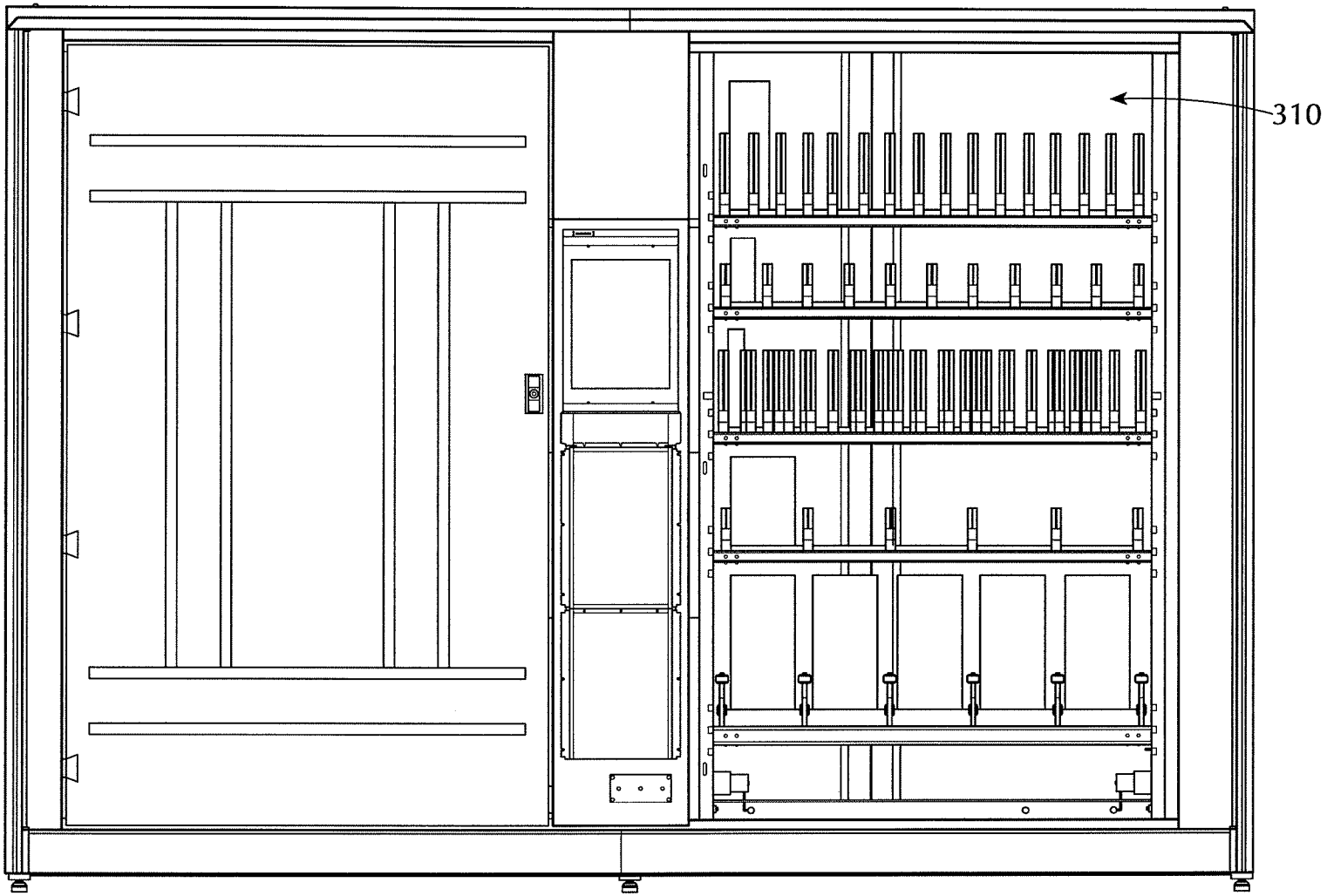
FIG. 3 shows the kiosk of FIG. 1 with a front panel removed.
Figure 4:
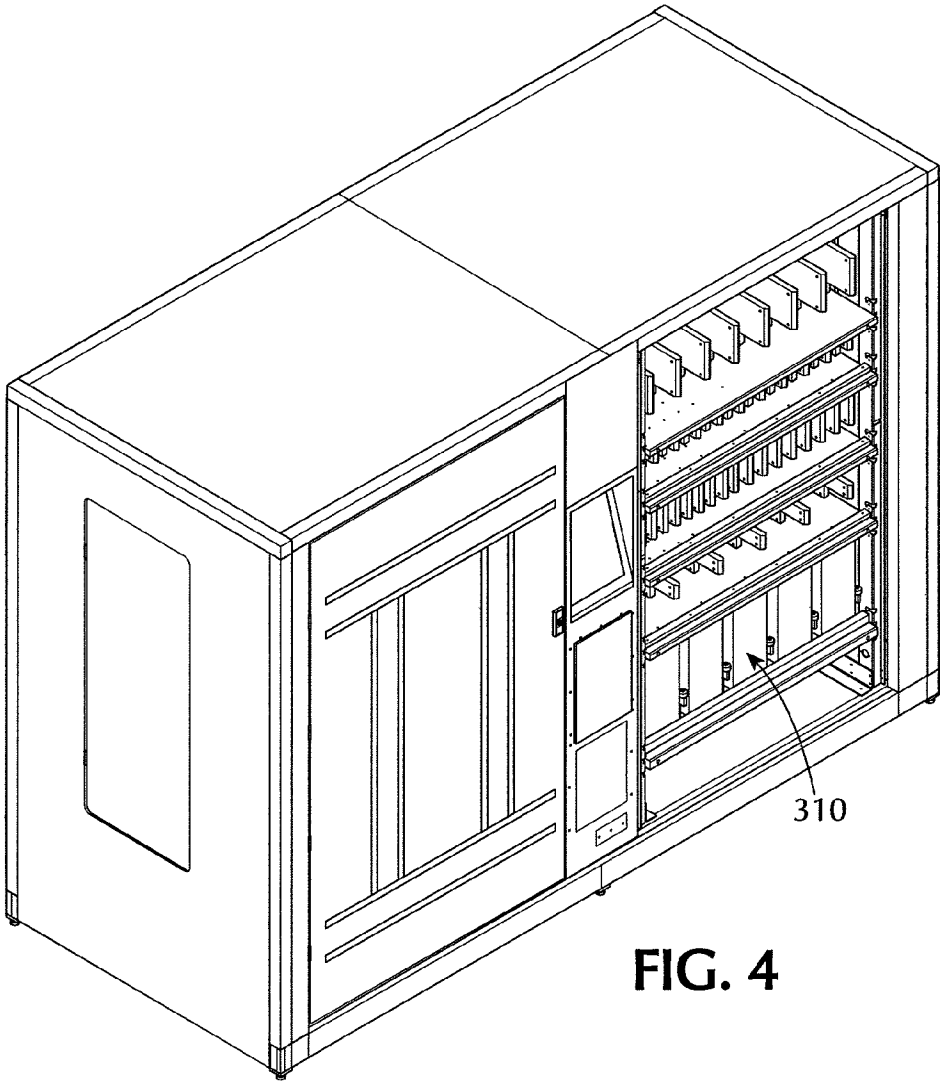
FIG. 4 shows a perspective view of FIG. 3.

FIGS. 3 and 4 show the interior of kiosk 200. In this instance, panel 220 is removed from kiosk 200. Inside the kiosk 200 there may a shelving system 310. Various packages may be stored on the shelving system 310.

Figure 5:
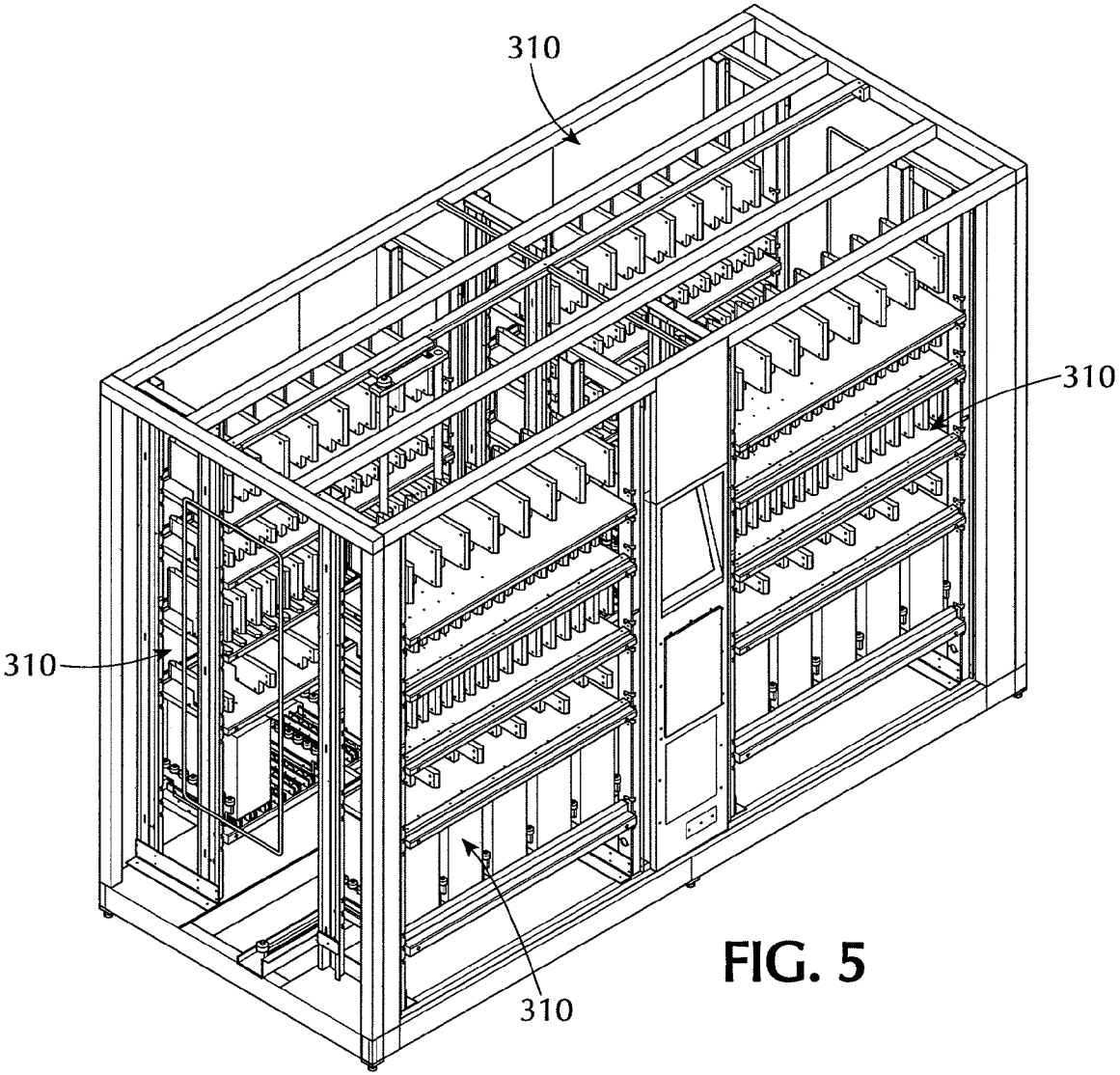
FIG. 5 shows the kiosk of FIG. 1 with the major panels removed.
Figure 6:
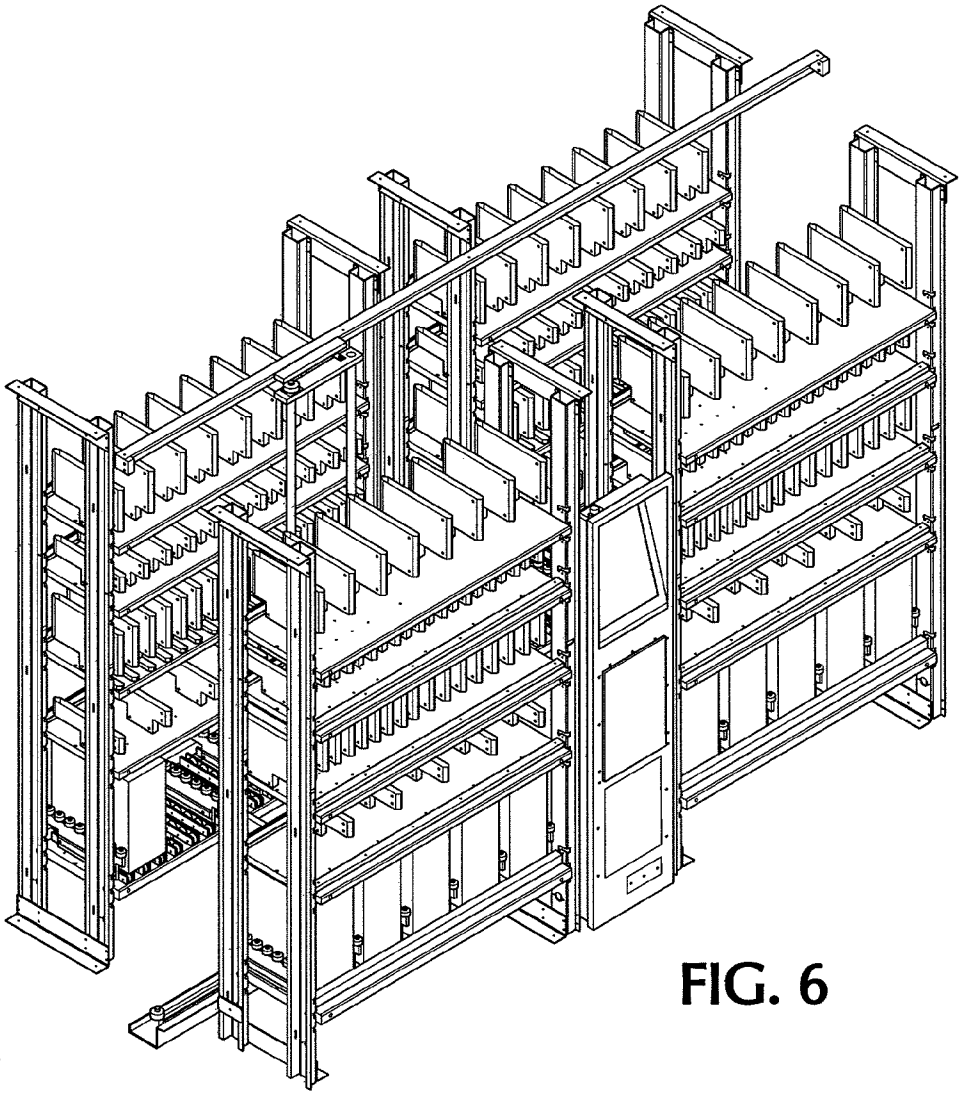
FIG. 6 shows all of the panels removed from the kiosk of FIG. 1.

FIG. 5 shows the interior of the kiosk 200 by having all of the panels removed. Four sets of shelves 310 may be seen inside. These shelves 310 are specially adapted for storing packages of various sizes including, for example, standard package shipping sizes. The shelves 310 may be adapted to work with an interior robotic retrieval system or Robotic Package Lifting Assembly (RPLA). FIG. 6 shows the entirety of the outer frame of the kiosk 200 removed.

Figure 7:
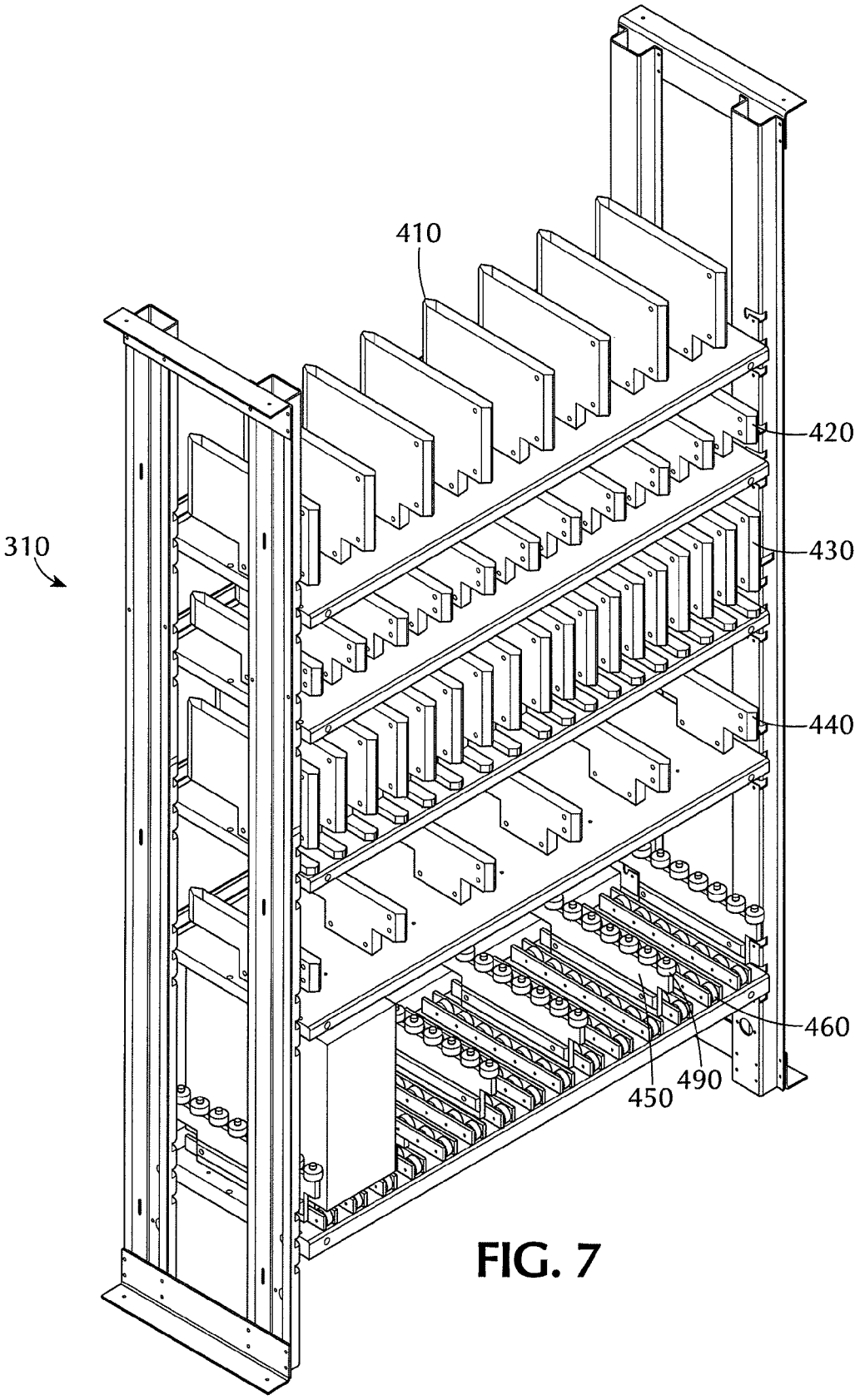
FIG. 7 shows one embodiment of a shelf for use in the kiosk of FIG. 1.

FIG. 7 shows one embodiment of a shelf 310 for use with the kiosk 200. In general, the shelves 310 have a number of features that make them specially adapted for usage in kiosk 200. First they have a variety of heights that are configurable between the slots. These heights may be configured to accommodate standard mailing packages and the like. Second, the shelves 310 have a number of apertures for receiving dividers. Therefore, different shelves 310 may be easily configured for different width items. Third, the dividers themselves have specially designed shapes and configurations. They are specially designed to accommodate gripper arms from a robotic retrieval device. For example, the dividers have to wider than the gripper arms or bars and may also include additional clearance for machine x-y clearance. There are also dividers designed to accommodate certain types of packages, such as the envelopes that serve as standard overnight packages and special roller packages for heavier packages. The dividers are mounted to the shelves using a variety of methods.

Figure 8:
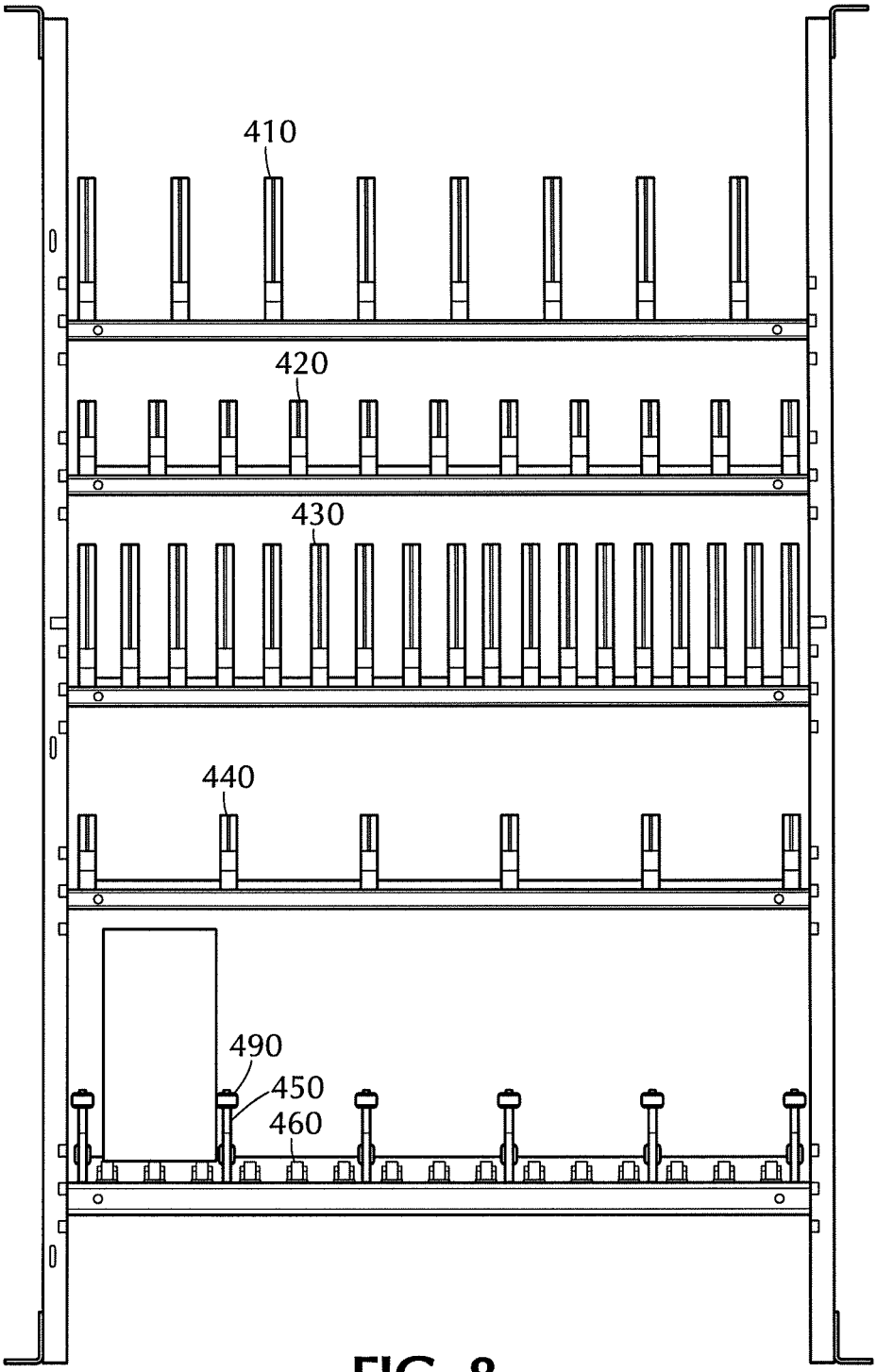
FIG. 8 shows a front view of the shelf of FIG. 7.

Referring to FIG. 7, the kiosk 200 may include dividers 410. These dividers 410 may be configured for the standard rate boxes that are used, for example, by post offices. The size of the box is generally in the 11"×8½"×5½" range. Dividers 420 are designed to accommodate lower profile boxes. The size of a box is generally in the 8⅝"×5⅜"×1⅝". Dividers 430 may be provided for envelopes that are specially designed to ensure that the envelopes remain as upright and square to all surfaces as possible to prevent jamming. These envelopes will generally be in the 12.5"× 9.5" range. Dividers 440 may be provided for another sized box. The size of box is generally in the 13⅝"×11⅞"×3⅜". Dividers 450 with wheels 490 and accompanying rollers 460 may be provided for heavy boxes that may require reduced friction for removal. The size of box is generally in the Large 12"×12"×5 ½". FIG. 8 shows a front view of the shelf 310 including dividers 410, 420, 430, 440 and 450. Also shown are the relationships between dividers 450 and rollers 460 and wheels 490.

Figure 9:
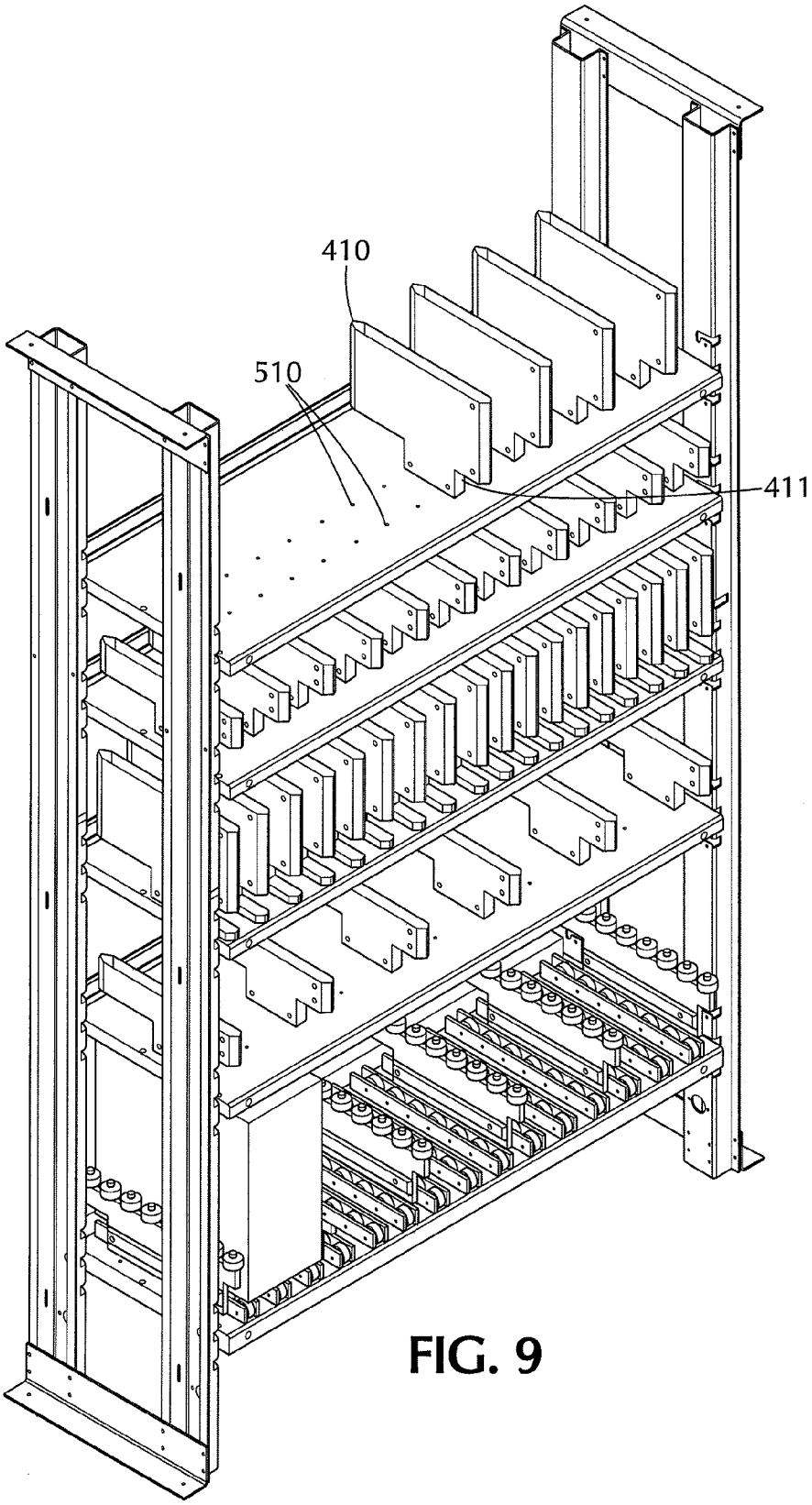
FIG. 9 shows the shelf of FIG. 7 with some of the dividers removed.

FIG. 9 shows shelving unit having a number of dividers 410 removed to reveal the spacing of apertures 510 for receiving the dividers 410. The apertures 510 shown on the left of the shelf are narrower than the mounted dividers, showing that various widths may be configured.

Figure 10:
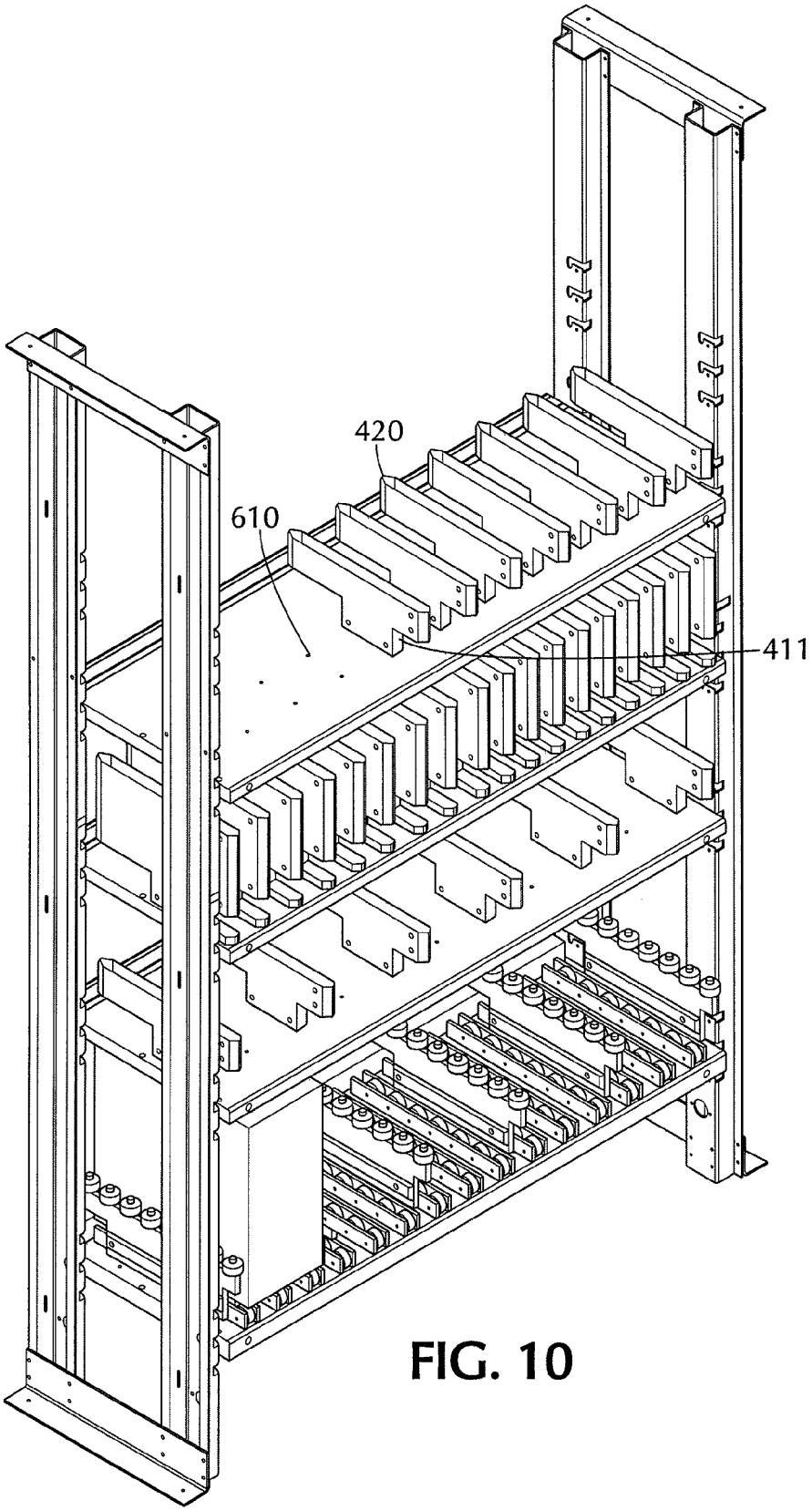
FIG. 10 shows the shelf of FIG. 7 with additional dividers and shelves removed.
Figure 11:
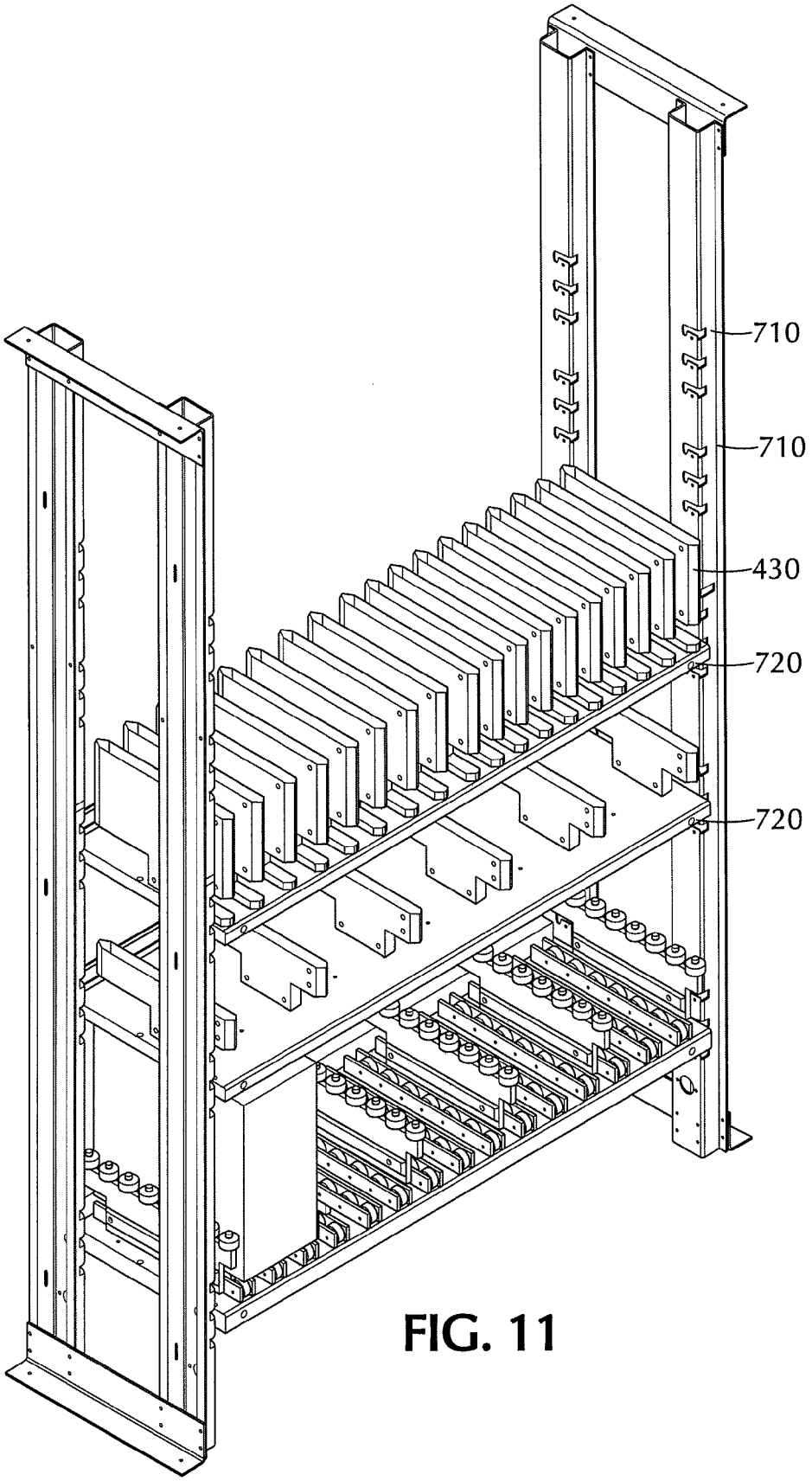
FIG. 11 shows the shelf of FIG. 7 with additional dividers and shelves removed.

FIG. 10 shows a configuration of dividers 420 and apertures 610. Similar to that shown in FIG. 9, the dividers 420 may be substituted in and out and the height of the shelf may be configured as can the widths between the shelves. In particular, FIG. 11 shows multiple slots 710 for height configuration of the shelves 720, which may have dividers 430. Referring back to FIG. 10, the dividers 420 may have a cutout portion 411 that provides for the engagement/disengagement of the gripper arms of a robotic package retrieval system.

Figure 12:
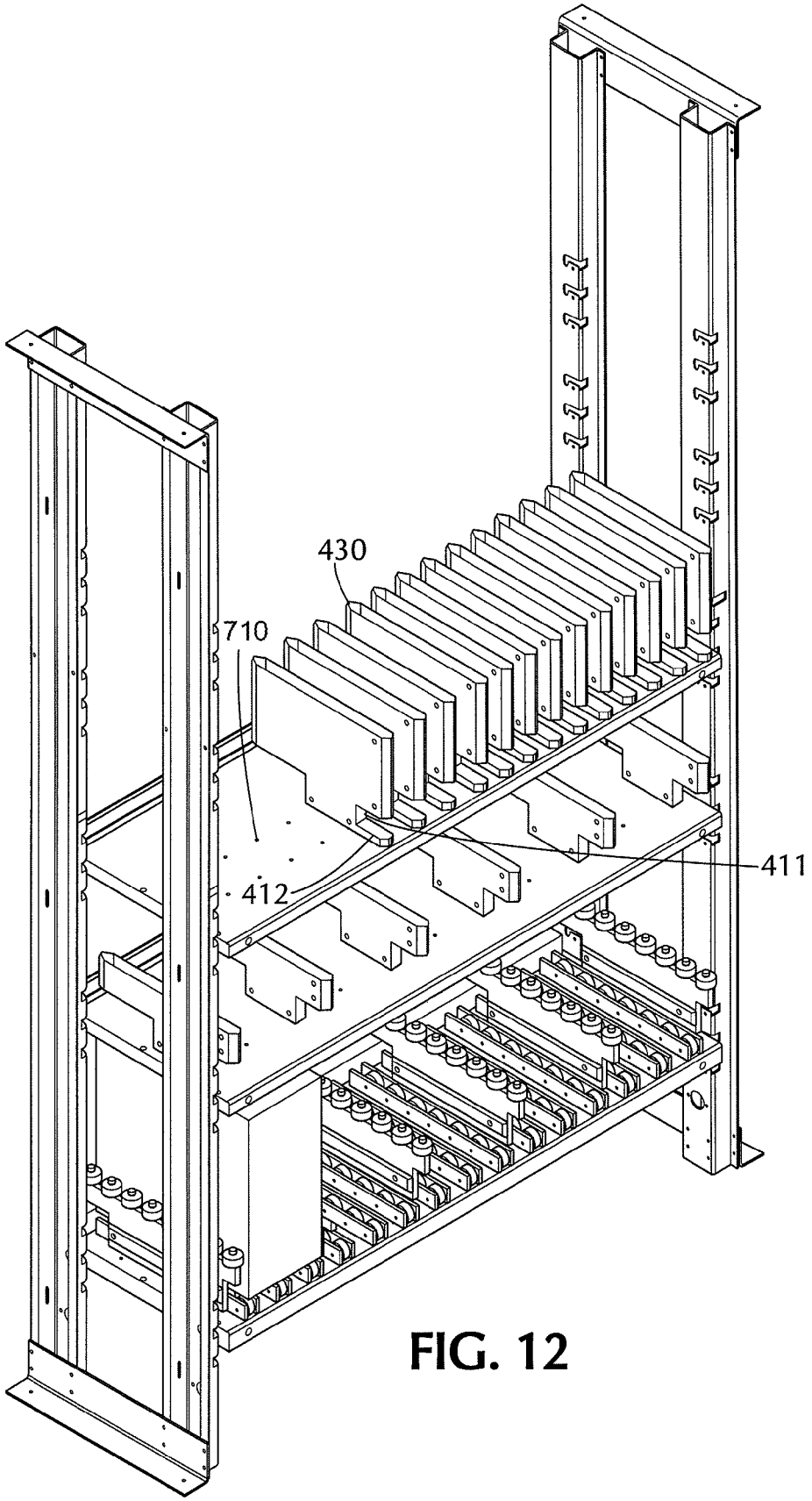
FIG. 12 shows the shelf of FIG. 7 with additional dividers and shelves removed.

FIG. 12 shows a configuration of dividers 430 and apertures 710. This provides a better cross-sectional view of the cut-out portion 411 that provides for the engagement of the gripper arms of a robotic package retrieval system. These dividers 430 may also include a lower base portion 412 that extends under the cut-out portion 411. This extension of the base prevents an envelope positioned in the slot from becoming twisted and jammed. The corner of the envelope may become awkwardly positioned in the slot and jammed in the aperture or cut-out portion 411 that provides access to the robotic arms without this base portion. The bottom portion provides for a bottom surface that most of the edge of an envelope may rest against. This provides for keeping the envelope straight, in that the edge is parallel to the divider as it rests against it.

Figure 13:
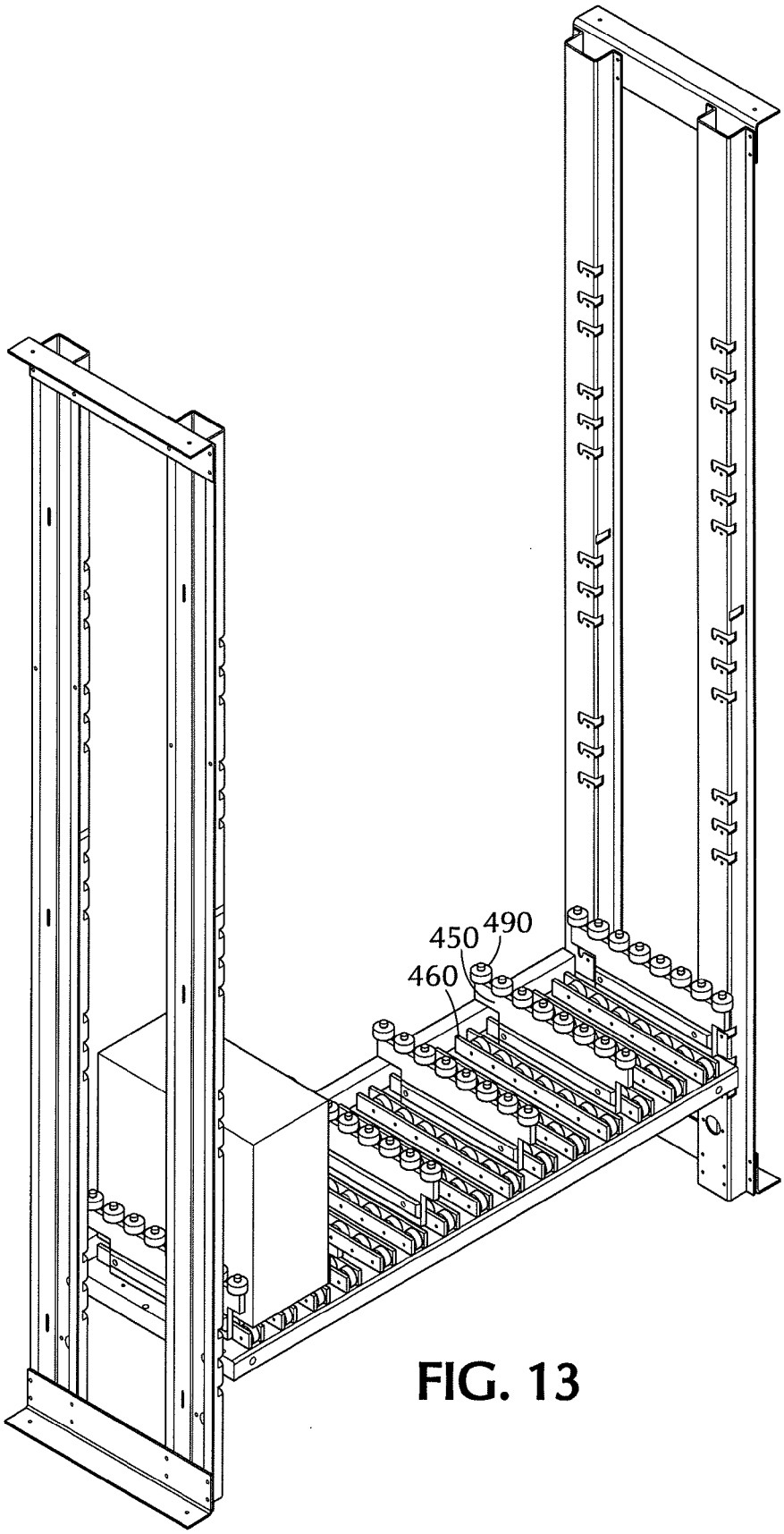
FIG. 13 shows the shelf of FIG. 7 with additional dividers and shelves removed.
Figure 14:
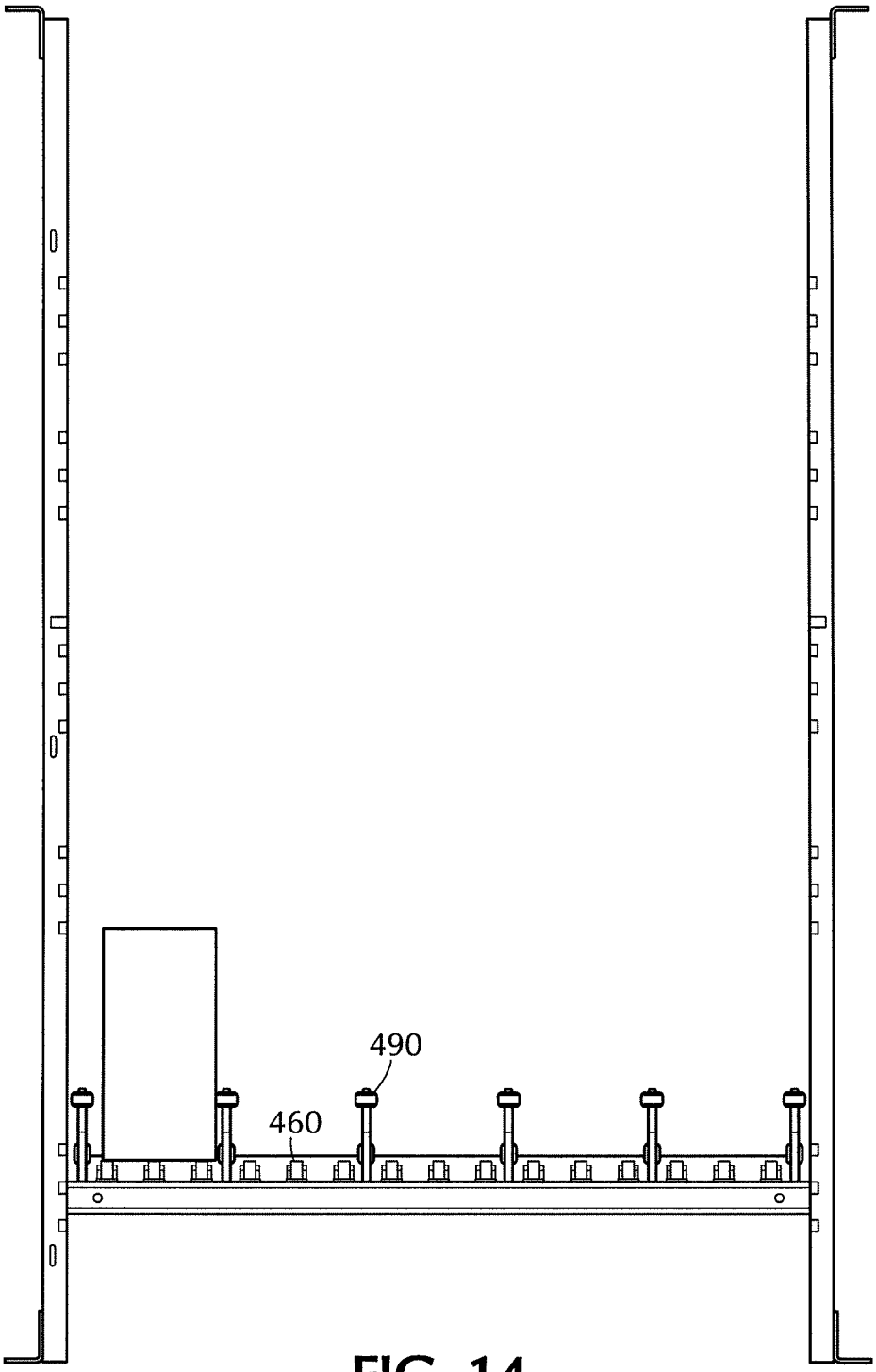
FIG. 14 shows the shelf of FIG. 7 with additional dividers and shelves removed.
Figure 15:
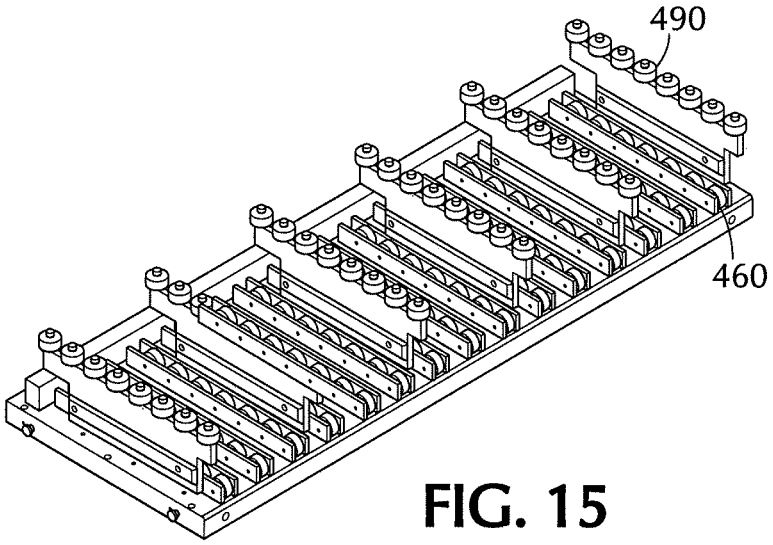
FIG. 15 shows a detailed view of the bottom shelf of FIG. 7.
Figure 16:
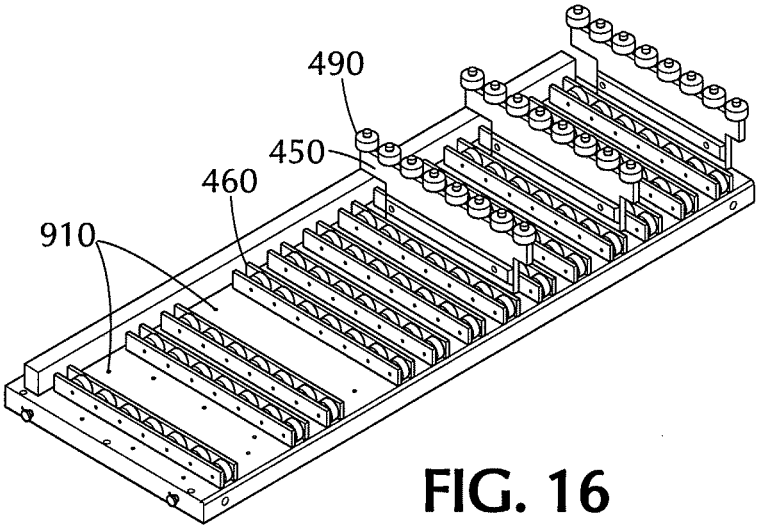
FIG. 16 shows another detailed view of the bottom shelf of FIG. 7.

FIG. 13 shows a bottom shelf that is configured to receive larger and heavier packages. The roller bases 460 and the dividers 450 that include top mounted wheels 490 provide for reduced friction and easier sliding for boxes that include heavier loads. By mounting the wheels or rollers 490 on top of dividers 450 as opposed to on their sides a space savings is achieved since only a single wheel is mounted as opposed to having two wheels mounted when in a side configuration. FIG. 14 shows a front view for a configuration of dividers 450, and rollers 460 and wheels 490. FIG. 15 shows a shelf removed from the shelving system that shows rollers 460 and 490. FIG. 16 shows a view where some roller bases 460 and wheels 490 have been removed to reveal apertures 910 in which the dividers 450 and the rollers 460 fit. The shelf itself may be the same as the other shelves as the apertures may be configured to fit the variety of dividers and rollers.

Figure 17:
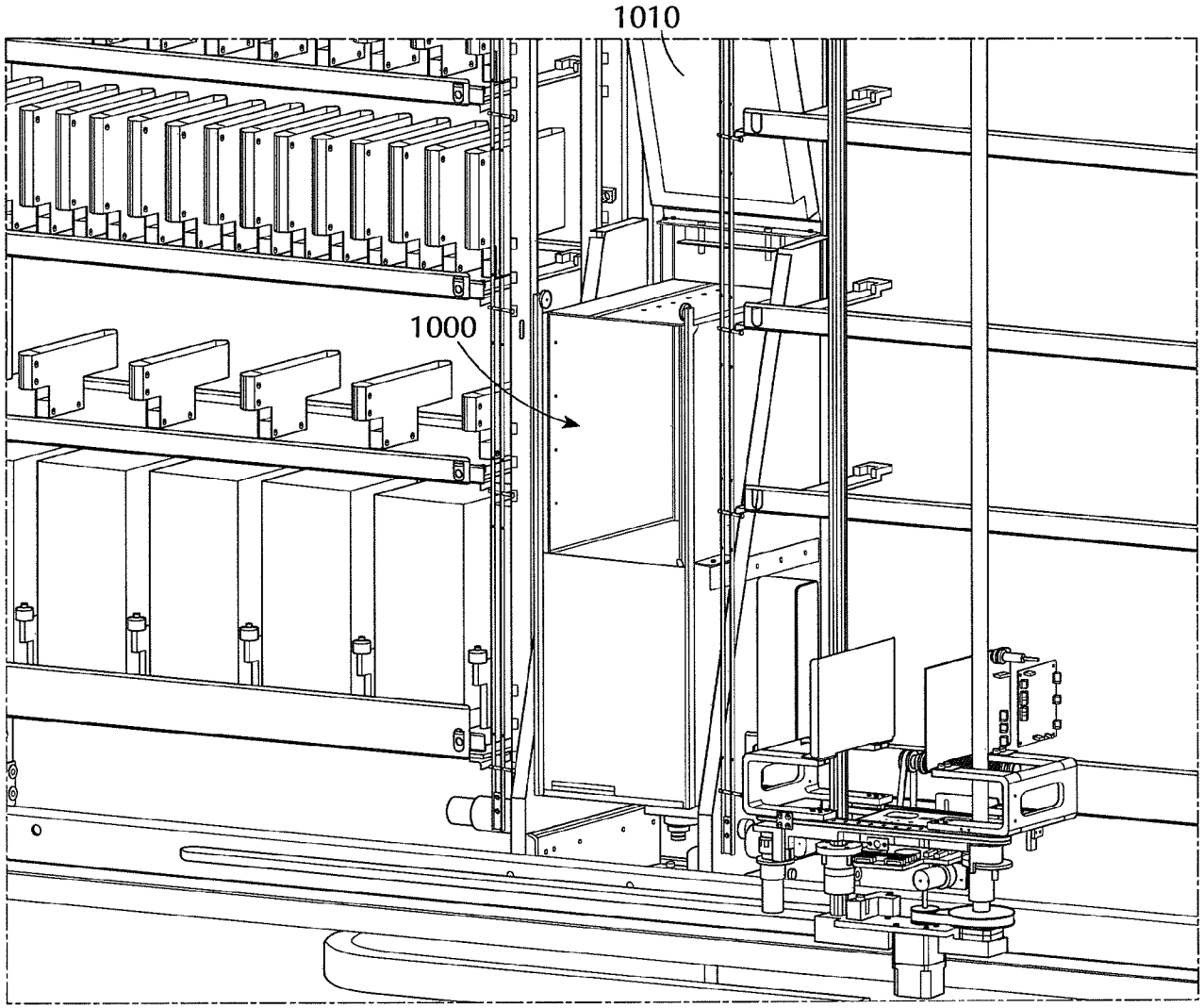
FIG. 17 shows an interior shot of the kiosk showing the delivery slot.

FIG. 17 shows the interior of a kiosk system including package slots 1000 through which a package may be delivered to a user. This slot 1000 and the accompanying interface 1010 are located between a set of shelves. The shelves are located along a track for a picker robot that may retrieve packages and deliver them to the slot 1000. Shelves may be located on either side of the picker robot track.

Referring further to the aperture for providing access to the robotic arms, this aperture provides for space savings in the shelving system. Additional space would be needed between the slots without these apertures. Each one of the dividers in the embodiment shown has such an aperture.

FIGS. 14-16 show rollers 460 and wheels 490 mounted on dividers 450. The wheels are mounted at the top of the dividers in order to take up minimum space and provider for little interference with the apertures that may receive the robotic grippers.

In general, a shelving system receives objects or packages from a robotic placement mechanism. The shelving system may include a plurality of shelves having a plurality of receiving apertures. The plurality of shelves may be parallel to the ground. The shelving system further includes a plurality of dividers configured to fit into the plurality of receiving apertures. Each of the plurality of apertures may have a substantially rectangular shape. Each of the plurality of dividers may have a receiving slot configured to allow for a robotic gripper arm to grab an object located in a first slot between a first divider and a second divider of the plurality of dividers or between a pair of dividers of the plurality of dividers. The receiving slot may be a rectangular cut-out in a corner of each of the plurality of dividers.

The plurality of dividers may include a first plurality of dividers of a first height and a second plurality of dividers of a second height. The first plurality of dividers of a first height are configured to provide a first height slot and second plurality of dividers of a second height is configured to provide a second height slot. In one alternative, the plurality of dividers may include a third plurality of dividers. Each of the third plurality of dividers may further include a base portion that may run along a bottom portion of each of the third plurality of dividers. The bottom portion being the portion that interfaces with the plurality of shelves. The base portion having a first thickness thicker than a second thickness of the plurality of dividers and having a low profile as compared to the size of the receiving slot. The base portion may provide a narrower opening such that the edge of a thin rectangular object stands in an alignment closer to perpendicular to the plurality of shelves as compared to without the base portion.

In another alternative, the plurality of dividers includes a fourth plurality of dividers and a plurality of rollers attached is attached to the fourth plurality of dividers. In one configuration, a plurality of roller bases is included between the fourth plurality of dividers. In another configuration, a portion of the plurality of rollers is attached to each of the fourth plurality of dividers along a top portion of each of the fourth plurality of dividers. The plurality of rollers may be disc shaped wheels attached with a single axle point. Alternatively, a height between the plurality of shelves is adjustable.

In one embodiment, a kiosk system for storing and distributing packages includes a kiosk body having a package delivery slot and an interface slot. The kiosk system may further include a first and second shelving system in the kiosk body. The first and second shelving system located on either side of the package delivery slot. The first and second shelving system may each include a plurality of shelves that may be parallel to the ground and have a plurality of receiving apertures. It may also have a plurality of dividers configured to fit into the plurality of receiving apertures. Each of the plurality of apertures may have a substantially rectangular shape. Each of the plurality of dividers may have a receiving slot configured to allow a robotic gripper arm to handle an object with respect to a slot between a first divider and a second divider or a pair of dividers of the plurality of dividers. For example, the receiving slot may allow the grabbing arm to grab an object located in the slot or may allow a grabbing arm to place an object in the slot.

In another embodiment, a kiosk system may include a package retrieving system located in the kiosk that is configured to receive commands from an interface located in the interface slot and control the package retrieving system to retrieve packages located in the shelving system. In one configuration, the receiving slot is a rectangular cut-out in a corner of each of the plurality of dividers. In another configuration, the plurality of dividers includes a first plurality of dividers of a first height and a second plurality of dividers of a second height, where the first plurality of dividers of a first height are configured to provide a first height slot and second plurality of dividers of a second height is configured to provide a second height slot.

In another configuration, the plurality of dividers may include a third plurality of dividers, where each of the third plurality of dividers may further include a base portion. The base portion may run along a bottom portion of each of the third plurality of dividers, where the bottom portion may be the portion that interfaces with the plurality of shelves. The base portion may have a first thickness thicker than a second thickness of the plurality of dividers and a low profile as compared to the size of the receiving slot. The base portion may provide a narrower opening such that the edge of a thin rectangular object stands in an alignment closer to perpendicular to the plurality of shelves as compared to without the base portion. The plurality of dividers may include a fourth plurality of dividers that may have a plurality of rollers.

In another embodiment, a kiosk may include a kiosk body that includes a package slot and an interface slot. The kiosk may further include at least one shelving system that includes shelves and a plurality of dividers. The shelves may be configured to accept the plurality of dividers and may be height adjustable. Each of the plurality of dividers may include a slot configured to allow for a mechanical gripper to handle an object with respect to a slot between a pair of dividers of the plurality of dividers. The slot may be a rectangular cut-out in a corner of each of the plurality of dividers. The plurality of dividers may include dividers having rollers. The rollers may be attached along a top portion of the dividers.

While specific embodiments have been described in detail in the foregoing detailed description and illustrated in the accompanying drawings, it will be appreciated by those skilled in the art that various modifications and alternatives to those details could be developed in light of the overall teachings of the disclosure and the broad inventive concepts thereof. It is understood, therefore, that the scope of this disclosure is not limited to the particular examples and implementations disclosed herein, but is intended to cover modifications within the spirit and scope thereof as defined by the appended claims and any and all equivalents thereof. Note that, although particular embodiments are shown, features of each attachment may be interchanged between embodiments.

What is claimed is:

1. A shelving system for receiving packages from a robotic placement mechanism, the system comprising:

a plurality of shelves, each of the plurality of shelves having a shelf length extending between a shelf front and shelf back and a shelf width extending between opposing shelf sides, the shelf width being longer than the shelf length, each of the plurality of shelves having a plurality of sets of receiving apertures disposed within a shelf top surface, each set of receiving apertures being spaced from each other; and a plurality of dividers configured to fit into corresponding sets of the plurality of receiving apertures, each pair of adjacent dividers defining one of a plurality of package storage slots having a package storage slot width extending between the pair of adjacent dividers, each divider of the plurality of dividers having:

a divider height extending between adjacent shelves;

a divider width extending from a first side of a divider to a second side of the divider, the second side of the divider opposing the first side of the divider, the first and second sides of the divider extending continuously along the divider height of the divider;

a divider length extending between a front of the divider and a back of the divider opposing the front of the divider; and a receiving slot defining a space within the divider extending a receiving slot length along the divider length from the front of the divider to an inner wall of the divider extending the divider width from the first side to the second side, the receiving slot length being less than half of the distance between the front of the divider and the back of the divider, a receiving slot width extending along the divider width from the first side of the divider to the second side of the divider and a receiving slot height extending along the divider height between a bottom of the divider and a top of the divider.

2. The shelving system of claim 1, wherein the receiving slot is a rectangular cut-out in a corner of each of the plurality of dividers.

3. The shelving system of claim 2, wherein the plurality of dividers includes a first plurality of dividers having a first divider height and a second plurality of dividers having a second divider height different from the first divider height, adjacent dividers of the first plurality of dividers defining first package storage slots having a first package storage slot height and adjacent dividers of the second plurality of dividers defining second package storage slots having a second package storage slot height different from the first package slot height.

4. The shelving system of claim 3, wherein the plurality of dividers includes a third plurality of dividers, each of the third plurality of dividers further including a base portion, the base portion running along a bottom portion of each of the third plurality of dividers, the bottom portion being the portion that interfaces with the plurality of shelves, the base portion having a first thickness extending between opposing base portion sides, the first thickness being thicker than a second thickness of a non-base portion of the plurality of dividers extending between opposing non-base portion sides, the base portion extending between the divider bottom and the receiving slot, the base portion having a low profile along the divider height compared to the receiving slot height, and adjacent base portions providing a more narrow opening at the bottom of each package storage slot than between adjacent non-base portions of the third plurality of dividers such that the edge of a thin rectangular object is prevented from being positioned in the receiving slot and the edge of the thin rectangular object stands in an alignment closer to perpendicular to the plurality of shelves as compared to without the base portion.

5. The shelving system of claim 4, wherein the plurality of dividers includes a fourth plurality of dividers and a plurality of rollers is attached to the fourth plurality of dividers.

6. The shelving system of claim 5, wherein a plurality of roller bases are included between the fourth plurality of dividers.

7. The shelving system of claim 6, wherein a portion of the plurality of rollers are attached to each of the fourth plurality of dividers along a top portion of each of the fourth plurality of dividers.

8. The shelving system of claim 7, wherein the plurality of rollers are disc shaped wheels attached with a single axle point.

9. The shelving system of claim 8, wherein a height between the plurality of shelves is adjustable.

10. A kiosk system for storing and distributing packages, the system comprising:

a kiosk body comprising one or more panels, one or more doors, a package delivery slot and an interface slot, a first shelving system and second shelving system each housed within the one or more panels and the one or more doors of the kiosk body, the first shelving system and the second shelving system located on opposing sides of the package delivery slot, the first shelving system and the second shelving system each including a plurality of shelves, each of the plurality of shelves including a plurality of sets of receiving apertures disposed within a shelf top surface, each set of receiving apertures being spaced from each other; and a plurality of dividers, the dividers configured to fit into corresponding sets of the plurality of receiving apertures, each pair of adjacent dividers defining one of a plurality of package storage slots having a package storage slot width extending between the pair of adjacent dividers, each divider of the plurality of dividers having:

a divider height extending between adjacent shelves;

a divider width extending from a first side of a divider to a second side of the divider, the second side of the divider opposing the first side of the divider, the first and second sides of the divider extending continuously along the divider height of the divider;

a divider length extending between a front of the divider and a back of the divider opposing the front of the divider; and a receiving slot defining a space within the divider extending a receiving slot length along the divider length from the front of the divider to an inner wall of the divider extending the divider width from the first side to the second side, the receiving slot length being less than half of the distance between the front of the divider and the back of the divider, a receiving slot width extending along the divider width from the first side of the divider to the second side of the divider and a receiving slot height extending along the divider height between a bottom of the divider and a top of the divider.

11. The kiosk system of claim 10, further comprising a package retrieving system, located in the kiosk, configured to receive commands from an interface located in the interface slot and control the package retrieving system to retrieve packages in the shelving system.

12. The kiosk system of claim 11, wherein the receiving slot is a rectangular cut-out in a corner of each of the plurality of dividers.

13. The kiosk system of claim 12, wherein the plurality of dividers includes a first plurality of dividers having a first divider height and a second plurality of dividers having a second divider height different from the first divider height, adjacent dividers of the first plurality of dividers defining first package storage slots having a first package storage slot height and adjacent dividers of the second plurality of dividers of a second height is configured to provide defining second package storage slots having a second package storage slot height different from the first package storage slot height.

14. The kiosk system of claim 13, wherein the plurality of dividers includes a third plurality of dividers, each of the third plurality of dividers further including a base portion, the base portion running along a bottom portion of each of the third plurality of dividers, the bottom portion being the portion that interfaces with the plurality of shelves, the base portion having a first thickness extending between opposing base portion, the first thickness being thicker than a second thickness of the plurality of dividers extending between opposing divider sides, the base portion extending between the divider bottom and the receiving slot, and adjacent base portions providing a more narrow opening at the bottom of each package storage slot than between adjacent non-base portions of the third plurality of dividers such that the edge of a thin rectangular object is prevented from being positioned in the receiving slot and the edge of the thin rectangular object stands in an alignment closer to perpendicular to the plurality of shelves as compared to without the base portion.

15. The kiosk system of claim 14, wherein the plurality of dividers includes a fourth plurality of dividers and a plurality of rollers is attached to the fourth plurality of dividers.

16. A kiosk, comprising:

a kiosk body comprising one or more panels, one or more doors, a package slot and an interface slot, at least one shelving system housed within the one or more panels and the one or more doors of the kiosk body, the at least one shelving system including a plurality of shelves, each of the plurality of shelves having a shelf length extending between a shelf front and shelf back and a shelf width extending between opposing shelf sides, the shelf width being longer than the shelf length;

a plurality of dividers disposed on the plurality of shelves, each pair of adjacent dividers defining one of a plurality of package storage slots having a package storage slot width extending between the pair of adjacent dividers, wherein each divider of the plurality of dividers includes:

a divider height extending between adjacent shelves;

a divider width extending from a first side of a divider to a second side of the divider, the second side of the divider opposing the first side of the divider, the first and second sides of the divider extending continuously along the divider height of the divider;

a divider length extending between a front of the divider and a back of the divider opposing the front of the divider; and a receiving slot defining a space within the divider extending a receiving slot length from the front of the divider to an inner wall of the divider extending the divider width from the first side to the second side, the receiving slot length being less than half of the distance between the front of the divider and the back of the divider, a receiving slot width extending from the first side of the divider to the second side of the divider and a receiving slot height extending along the divider height between a bottom of the divider and a top of the divider, the receiving slot length, width and height sufficient for allowing a mechanical gripper to handle an object within a corresponding package storage slot.

17. The kiosk of claim 16, wherein the slot is a rectangular cut-out in a corner of each of the plurality of dividers.

18. The kiosk of claim 16, wherein the plurality of dividers includes dividers having rollers.

19. The kiosk of claim 18, wherein the rollers are attached along a top portion of the dividers.

20. The kiosk of claim 19, wherein a height between the plurality of shelves is adjustable.

* * * * *